United States Patent [19]

Stubbings

[11] 4,162,641

[45] Jul. 31, 1979

[54] AUTOMATIC LOADING AND UNLOADING FOR NUMERICALLY CONTROLLED TURRET PUNCH

[75] Inventor: James H. Stubbings, Rockville, Md.

[73] Assignee: Potomac Applied Mechanics, Inc., Bethesda, Md.

[21] Appl. No.: 846,532

[22] Filed: Oct. 28, 1977

[51] Int. Cl.[2] ..... B65H 29/28; B65H 31/20

[52] U.S. Cl. ..... 83/71; 83/92; 83/94; 83/391; 83/412; 83/417; 83/552; 271/223; 414/32

[58] Field of Search ..... 83/71, 92, 92.1, 94, 83/281, 417, 552, 391, 467, 412; 214/1 BB, 6 F, 6 H, 8.5 A, 8.5 F, 8.5 H; 271/4, 171, 223, 224

[56] References Cited

U.S. PATENT DOCUMENTS

| | | | |
|---|---|---|---|
| 2,164,371 | 7/1939 | Ajello | 214/6 H |
| 2,626,800 | 1/1953 | Martin | 214/6 H |
| 2,665,633 | 1/1954 | Schubert | 214/6 H |
| 3,203,288 | 8/1965 | Blumer | 83/92 |
| 3,357,700 | 12/1967 | Bradicich | 271/171 X |
| 3,717,061 | 2/1973 | Daniels | 83/552 X |
| 3,765,284 | 10/1973 | Maiorino | 83/71 |
| 3,976,208 | 8/1976 | Boix et al. | 214/6 H |
| 3,993,300 | 11/1976 | Dehner | 271/4 |

FOREIGN PATENT DOCUMENTS

| | | | |
|---|---|---|---|
| 1188745 | 3/1959 | France | 214/8.5 H |

*Primary Examiner*—J. M. Meister

*Attorney, Agent, or Firm*—Cushman, Darby & Cushman

[57] ABSTRACT

An assembly for automatically feeding workpieces to and from a numerically controlled turret punch. A loader magazine having an adjustable volume for receiving a stack of workpieces is disposed on one side of a turret punch, and an unloader magazine having a similar adjustable volume for receiving a stack of workpieces is disposed on the opposite side of the turret punch. An ejector associated with a loader magazine ejects the top workpiece from the loader magazine to horizontally feed it into operative association with clamps of the turret punch. The turret punch clamps are moveable with respect to the punching tools, and the punching tools are moveable and operated to effect punching of the workpiece until it has a desired finished configuration. Then the workpiece is moved into engagement with rollers on the unloader magazine and powered into the unloader magazine, while the next workpiece is readied for movement from the loader magazine—or simultaneously with movement of the next workpiece from the loader magazine. Horizontally and vertically moveable locator stops are associated with the turret punch table to facilitate movement of the workpieces into engagement with the turret clamps. The loader and unloader magazines are also numerically controlled.

16 Claims, 9 Drawing Figures

Fig. 5
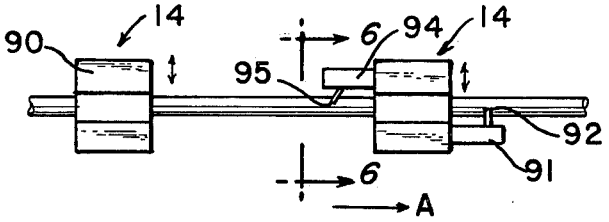
Fig. 6
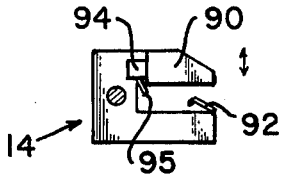
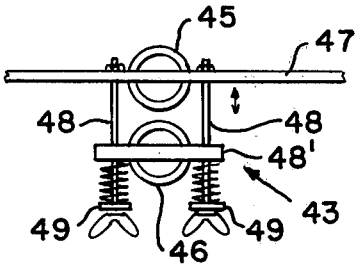
Fig. 7
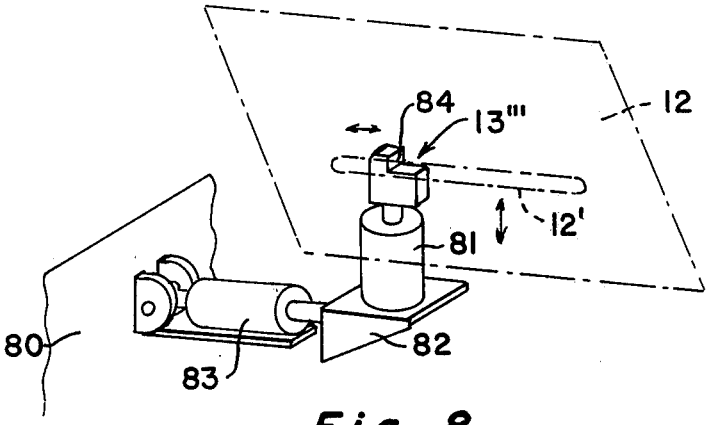
Fig. 8
Fig. 9
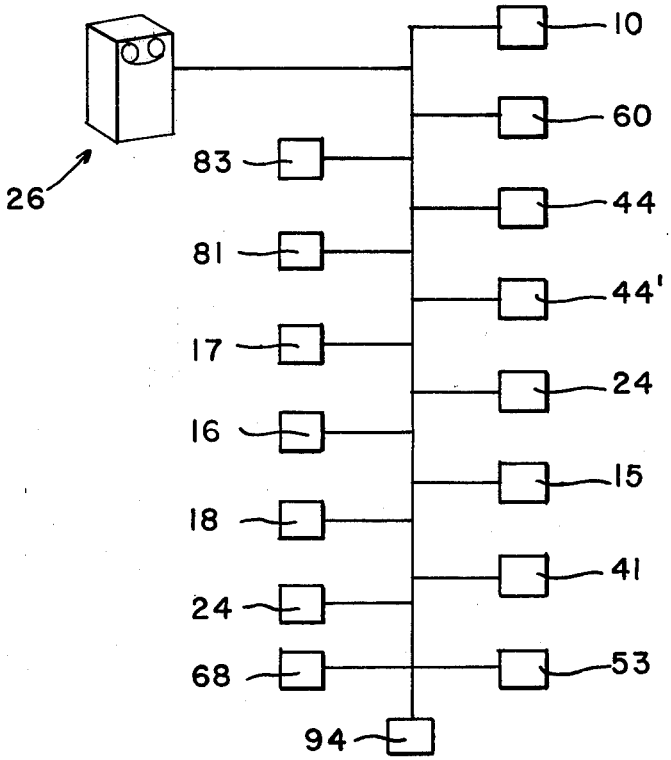

AUTOMATIC LOADING AND UNLOADING FOR NUMERICALLY CONTROLLED TURRET PUNCH

BACKGROUND AND SUMMARY OF THE INVENTION

At present, numerically controlled turret punches have gained wide acceptance in the field. Such turret punches are operable to accurately punch in a high speed manner a wide variety of hole designs and positions without any operator input aside from the initial positioning of the workpiece and moveable clamps, and programming of the numerical control means. However, there is a need in the industry for relatively inexpensive automatic feeding and withdrawal means for the workpieces for certain types of jobs, so that one operator may operate a plurality of turret punches at the same time. In addition to being inexpensive, such loaders and unloaders for which the need exists must be adaptable to a wide variety of sizes of sheet metal pieces to be punched, must be portable, must be simple, and should be adaptable for numerical control. A common numerical control is thus able to feed the work pieces into position, automatically punch them to produce a finished workpiece and the desired hole configurations, remove the workpiece from the table and stack it, and continue this operation until all of the workpieces in the loading stack are exhausted, without any operator input being necessary during the cycle.

According to the present invention, an automatic workpiece feeding assembly has been provided for a numerically controlled turret punch or the like that satisfies the above needs. The assembly according to the present invention is utilizable with virtually any conventional numerically controlled turret punch (or like structure) on the market today, including those made by Warner and Swasey (i.e. the Wiedematic W-2040, W-3050, or W-4560), Di-Acro (i.e. QCT-20, VT/19), Strippit (i.e. Fabri-Center 1000 II), Behrens (Performance Plus series), etc.

The assembly according to the present invention includes a loader magazine having an adjustable volume for receiving a stack of workpieces to be fed to a turret punch or the like; ejector means associated with the loader magazine for horizontally feeding workpieces one at a time in a feed direction from the loader magazine receiving volumes to a turret punch or the like into operative association therewith; an unloader magazine having an adjustable volume for receiving a stack of workpieces to be received from a turret punch or the like; and automatic means for controlling the loader magazine and unloader magazine to transfer each workpiece in a stack from the loader magazine to the turret punch or the like, and to the unloader magazine. Power means may be associated with locator stops on the turret punch table for moving the stops vertically between positions above and below the table, and for moving the stops horizontally toward and away from the clamping means associated with the turret punch, so that a workpiece engaged by the locator stops may be moved from a position horizontally spaced from the clamping means into operative association with the clamping means.

The adjustable volume for receiving a stack of workpieces for each of the said loader and said unloader magazine preferably comprises first and second side walls disposed generally parallel to the direction of feed of workpieces from or into the magazine, means for automatically adjusting horizontal spacing between the first and second side walls, workpiece support members associated with each of the side walls, means for automatically vertically moving the workpiece support members with respect to the side walls, a third side wall member disposed generally perpendicular to the direction of feed of workpieces from or into the magazine, and means for automatically horizontally moving the third side wall member in and opposite to the direction of feed. The ejector means preferably includes a moveable ejector plunger for engaging the top workpiece in a stack in a loader magazine, and means for operatively mounting the ejector plunger on the third side wall; and two pairs of rollers operatively mounted to the first and second side walls at the front portions thereof, including power means for driving the rollers to continue feeding of a workpiece grasped thereby in the feed direction. Similar rollers are also mounted on the unloader magazine for engaging a workpiece from the turret punch and power the workpiece into operative relationship with the stack of workpieces in the unloader volume.

The automatic control means for controlling the loader magazine and unloader magazine to transfer each workpiece in a stack from the loader magazine to the turret punch and to the unloader magazine preferably comprises numerical control means—preferably the same numerical control means utilized for controlling the turret punch. The numerical control means operates to activate the ejector means to move the top workpiece in the stack in the loader magazine into operative association with the turret punch, activates the means for vertically moving the workpiece support members of the loader magazine to position the next workpiece in the stack into position to be acted upon by the ejector means, activates the unloader magazine workpiece support members to lower the top workpiece in the stack to receive another workpiece thereon from the turret punch and activates the workpiece engaging means associated with the unloader magazine for moving a workpiece from the turret punch onto the stack in the unloader magazine. The locator stops on the turret punch table are also controlled by the numerical control means, and the means for positioning the first, second, and third walls of the magazines with respect to each other may also be numerically controlled. Both magazines preferably are mounted on casters so that they may be moved into position when the automatic feed capability is desired, and moved out of position for use of the turret punch in a conventional manner.

It is the primary object of the present invention to provide a relatively inexpensive practical automatic workpiece feeding system for a numerically controlled turret punch or the like. This and other objects of the invention will become clear from an inspection of the Detailed Description of the Invention, and from the appended claims.

BRIEF DESCRIPTION OF THE DRAWINGS

FIG. 5 is a detailed schematic front view of exemplary clamping means associated with a turret punch utilizable with the assembly according to the invention;

FIG. 6 is a side view of the clamping means of FIG. 5 taken along lines 6—6 of FIG. 5;

FIG. 7 is a detailed side schematic view of exemplary rollers utilizable to drive workpieces from the loader magazine or into the unloader magazine according to the invention;

FIG. 8 is a detailed schematic view—showing the turret punch table in dot-dash-line—of exemplary locator stops for use in the invention; and FIG. 9 is a diagramatic showing of an exemplary numerical control arrangement utilizable with the invention.

DETAILED DESCRIPTION OF THE INVENTION

Figure 1:
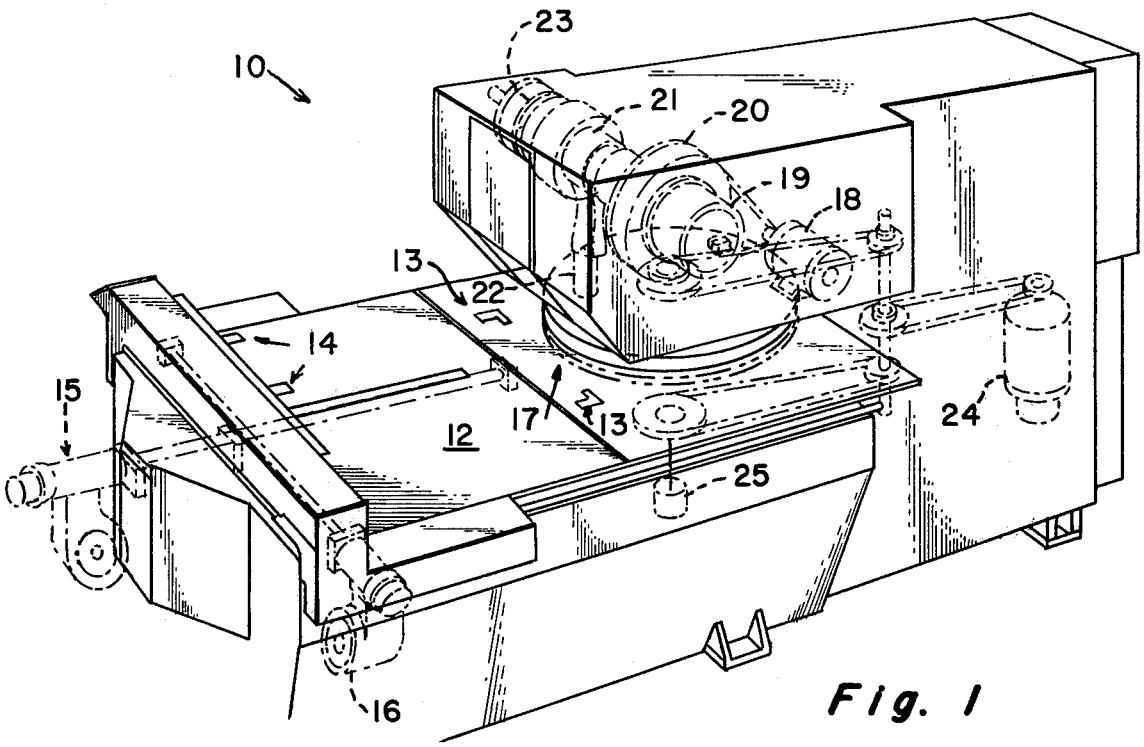
FIG. 1 is a prospective view of an exemplary conventional turret punch (i.e. Wiedematic W-2040) showing the operative components thereof.

A conventional numerically controlled turret punch on the market today (a Wiedematic W-2040 made by Warner and Swasey) is shown schematically at 10 in FIG. 1. The turret punch 10 includes a table 12 having locator stops 13 associated therewith, clamping means 14 for engaging a workpiece and moving it in the x or y horizontal directions with respect to the turret punches 17, the motors 15 and 16 providing movement of the clamping means 14 in the y and x directions respectively, and a DC servo-drive motor 18 for powering the punching mechanism. The motor 18 is connected up to a fly-wheel 20, and a clutch 19, pitman 21, ram 22, and brake 23 are provided for operating the punches associated with turret 17. The correct punch on the turret 17 is automatically rotated into operative position with the ram 22 by the turret drive motor 24, which interacts with the turret feedback mechanism 25. A conventional computer 26 is provided for controlling the clamps 14, and motors 15, 16, 18, and 24 for effecting punching of a workpiece with the desired configuration.

Figure 2:
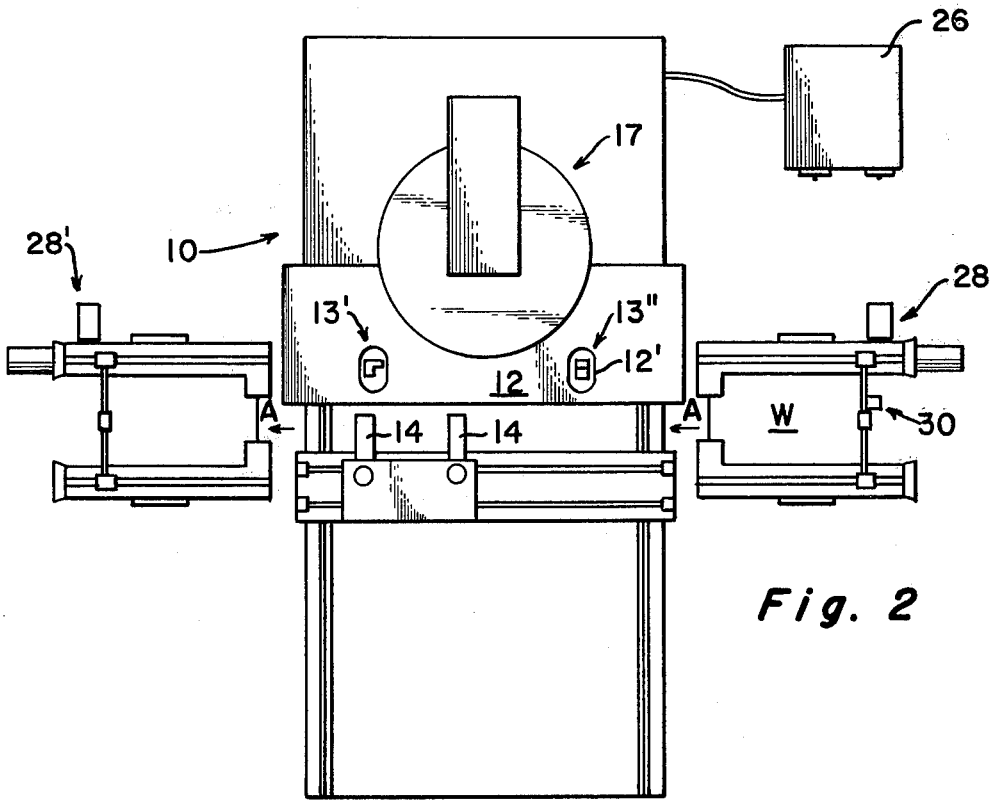
FIG. 2 is a top plan view of another conventional turret punch (i.e. Di-Acro VT/19) with loader and unloader magazines according to the present invention in operative association therewith.

In FIG. 2 a similar conventional numerically controlled turret punch (i.e. Di-Acro VT/19) is shown in conjunction with a loader magazine 28 and an unloader magazine 28' according to the present invention. The loader magazine 28 has an adjustable volume for receiving a stack of workpieces (metal sheets) to be fed to the turret punch 10, and ejector means 30 are associated with the magazine 28 for horizontally feeding workpieces W one at a time in a feed direction A from the loader magazine 28 receiving volume to the turret punch 10 into operative association therewith. The unloader magazine 28' is substantially the same as the loader magazine 28 except that it need not have ejector means 30, and it has an adjustable volume for receiving a stack of workpieces to be received from the turret punch 10. Automatic means are provided—such as computer 26 associated with all of the various motors of the loader magazine 28 and unloader magazine 28' to be hereinafter described—for controlling the magazines 28, 28' to transfer each workpiece in a stack from the loader magazine 28, to the turret punch 10, and to the unloader magazine 28'.

The adjustable volume for receiving a stack of workpieces W for each of the loader magazine and the unloader magazine comprises the following: First and second side walls 31, 32 (see FIGS. 3 and 4 in particular) disposed generally parallel to the direction of feed A of workpieces from and into the magazine 28, 28'. Means 33 for automatically adjusting the horizontal spacing between the first and second side walls 31, 32. Workpiece support members 34 associated with each of the side walls 31, 32. Means 35 for automatically vertically moving the workpiece support members 34 with respect to the side walls 31, 32. A third side wall member 36 disposed generally perpendicularly to the direction of feed A of workpieces W from or into the magazine 28, 28'; and means 37 for automatically horizontally moving the third side wall member 36 in and opposite to the direction of feed A.

Figure 3:
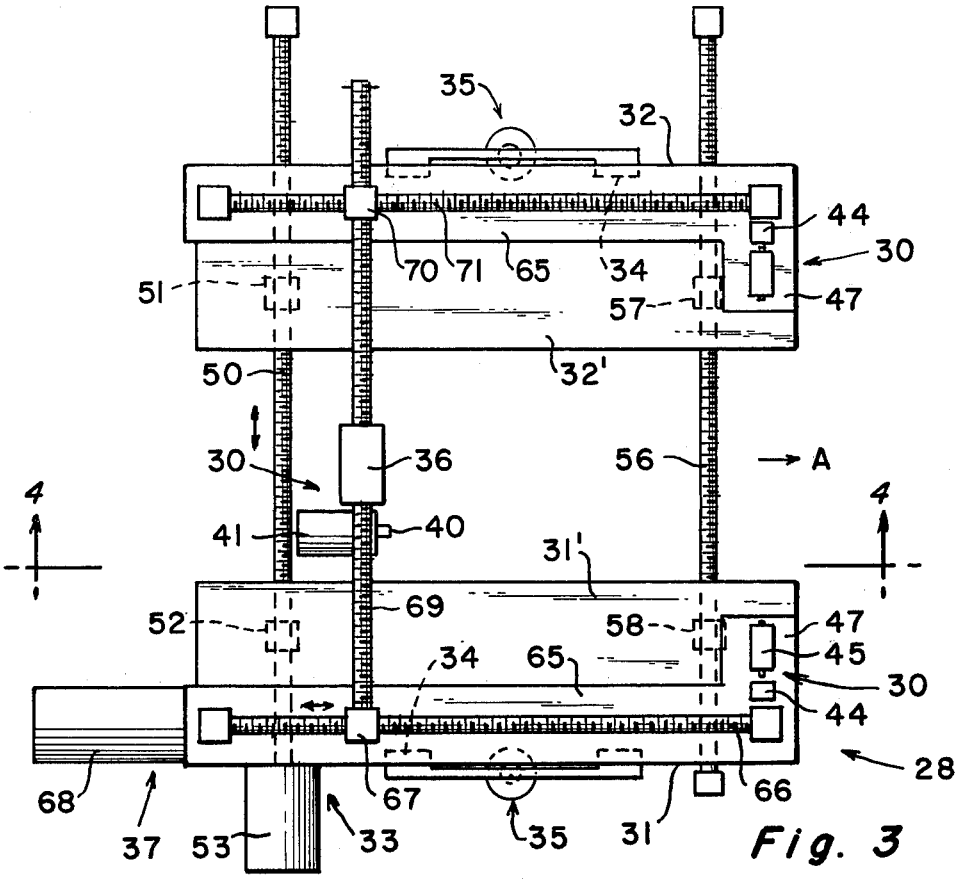
FIG. 3 is a top plan detailed view of an exemplary loader magazine according to the present invention.
Figure 4:
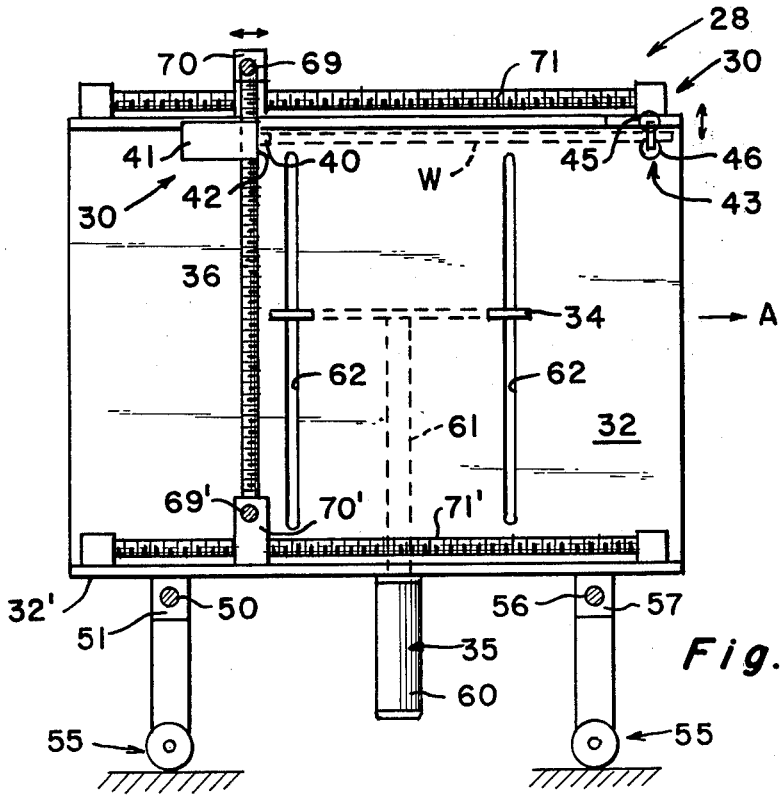
FIG. 4 is a side view taken along lines 4—4 of FIG. 3 of the magazine of FIG. 3.

While only the loader magazine 28 is shown in FIGS. 3 and 4, it is to be understood that the unloader magazine 28' is substantially identical to the loader magazine 28, except that the ejector means 30 need not be provided; however, the unloader magazine will comprise means for engaging a workpiece from the turret punch 10 and powering the workpiece into operative relationship with the stack of workpieces in the unloader volume.

The ejector means 30 preferably comprises two elements; a moveable plunger 40, and two pairs of powered rollers 43, mounted at the back and front of the workpiece receiving volume of the magazine respectively. The moveable plunger 40 is powered by a power source 41, such as a hydraulic cylinder, and means 42—such as a weld or bolts—are provided for mounting the plunger 40 on the third side wall member 36 at the proper height for engagement of the top workpiece W in the stack by the plunger 40 to move the workpiece W into operative engagement with the rollers 43. The normal position of the plunger 40 is shown in FIG. 4, and the dotted line position of the plunger 40 in FIG. 4 indicates that the movement of the plunger 40 pushes the workpiece W at the top of the stack into engagement with the roller assemblies 43.

Each roller assembly 43 comprises an upper roller 45 and a lower roller 46, with a power source 44 for rotating the upper rollers 45. The power sources 44 and the upper rollers 45 are mounted on a plate 47 located at the "front" end of the magazine 28—opposite the third side wall member 36. As shown in FIG. 7, adjustment means may be provided for adjusting the spacing the rollers 45, 46 of each roller set 43 in order to acommodate workpieces having different thickness. The adjustment may comprise a pair of guide rods 48 on which a mount 48' for the lower roller 46 rides, with adjustable spring biasing means 49. Only two of the members 48 are provided, and the member 48' is more or less a cantilever member extending from the exterior periphery of the plates 47 so that no abutment surfaces are provided for interfering with feeding of the workpieces W in direction A. Alternatively, the bottom roller 46 could be supported by the side walls 31, 32, or by the bottom plates 31', 32' associated with the respective side walls, and the members 48, 49 may be eliminated. Once a workpiece is grabbed by the roller sets 43 it is powered into position on the table 12 of the turret punch 10 or the like.

The means 33 for automatically adjusting the horizontal spacing between the first and second side walls 31, 32 includes a screw rod 50 in operative association with a traveling nut 51 connected to the bottom plate 32' of the wall 32, and a stationary bushing 52 connected to the bottom of bottom plate 31' of side wall 31. A rotating motor 53 is provided, rotation of the motor 53 resulting in rotation of screw 50, and the traveling nut 51 transforming rotation of screw 50 into linear reciprocal movement of the wall 32 with respect to the wall 31 depending upon the direction of rotation of the screw 50. A guide rod 56 is also provided mounted parallel to the screw 50 opposite thereof so that all portions of the walls 31, 32 move parallel, the guide rod 56 being received by bushing 57 attached to the bottom of plate 32' and bushing 58 attached to the bottom of plate 31'. As shown in FIG. 4, casters 55 are provided attached to the nuts 51 and the bushing 57 to allow for the relative movement between the walls 31, 32, and preferably casters 55 are also provided attached to the bushings 52, 58 so that the whole magazine 28, 28' is moveable. Suitable locking mechanisms for the castors can be provided to lock the magazines 28, 28' in place once they have been moved into operative association with the turret punch 10.

The means 35 for automatically vertically moving the workpiece support members 34 preferably include a power source such as a hydraulic cylinder 60 (see FIG. 4) or the like connected through a vertically extending rod 61 to each respective support 34, the supports 34 riding in slots 62 formed in the respective side wall 31, 32 (see FIG. 4).

In order to provide for movement of the third side wall member 36 in and opposite to the direction of feed A, a pair of top plates 65 are provided attached to the side walls 31, 32, with a screw threaded rod 66 and traveling nut 67 mounted on one of the plates 65, and a guide rod 71 and guide bushings 70 mounted on the other plate 65 (see FIG. 3). A rotating motor 68 is connected up to the screw rod 66, and rotation of the rod 66 by motor 67 is transformed by the traveling nut 67 into reciprocal movement of the nut 67, and the rod 69 and bushing 70 connected to nut 67. The rod 69 is operatively connected to the third side wall member 36. As can be seen in FIG. 4, guide members are provided located on the bottom plates 32', 31' also, in order to insure proper movement of the member 36 and to insure that it be maintained in a generally vertical plane, a connecting rod 69', bushing 70', and guide rod 71' being shown in FIG. 4, and comparable structures (or another screw rod and traveling nut arrangement) being provided associated with plate 31'. The locator stops 13 associated with the table 12 of the turret punch are modified according to the present invention to provide for cooperation with the loader and unloader magazines 28, 28'. The locator stops are shown at 13' and at 13'' in FIG. 2, and the stop 13' is shown in more detail in FIG. 8. The locator stop 13' is operatively connected to a stationary member 80, and a cylinder 81 mounted to a horizontally extending support 82 is provided for movement of the locator stop 13' in the vertical direction above and below the plane of the table 12 (shown in dot-line in FIG. 8). The cylinder 81 is conventional with numerically controlled turret presses, however, according to the present invention a second cylinder 83 is provided for movement of the support 82—and thus the locator stop itself—in a horizontal direction toward and away from the clamping means 14. Slots 12' are provided in the table 12 to allow such horizontal reciprocal movement. The locator stop 13'' preferably has a single abutment face 84 disposed parallel to the direction of feed A for engaging the edge of a workpiece W, and the locator stop 13' has two workpiece engaging faces, one parallel to the direction A and the other perpendicular thereto for stopping the movement of a workpiece W in direction A. Alternatively, the stop 13'' also could have such a second, perpendicularly disposed (to the feed direction A) abutment face. By activation of the cylinders 83 when the abutment face 84 of locator stop 13'', and cooperating abutment faces of the locator stop 13', are in engagement with the edge of the workpiece W, the workpiece will be moved perpendicular to the feed direction into operative association with the clamping means 14.

Exemplary clamping means are shown schematically in FIGS. 5 and 6, and include a top portion 90 that is pneumatically or otherwise moveable up and down to clamp and release a workpiece W received thereby. A micro-switch 91 may be mounted on one of the clamping means 14, with an actuator 92 disposed to actuate the micro-switch 91 upon movement of a workpiece W into position below the clamp portion 90, the micro-switch 91 with cam actuator 92 comprising sensing means. Actuation of micro-switch 91 results in actuation of the pneumatic or like source for moving the portion 90 of clamping means 14 downwardly into clamping engagement with the workpiece W. Additionally, a workpiece engaging assist 94, with workpiece engaging arm 95, may be provided mounted on one of the clamping means 14 to initially push the workpiece—after release by the clamping means 14—toward the unloader magazine 28'. The source 94 can comprise any source that moves the arm 95 downwardly into engagement with the top of the workpiece, and then reciprocates the arm 95 to give an initial velocity to the workpiece in movement in the feed direction A.

As previously mentioned, the unloader magazine 28' comprises means for engaging a workpiece from the turret punch 10 and powering the workpiece into operative relationship with the stack of workpieces in the unloader volume. Such means preferably comprises two pairs of rollers 43 operatively mounted to the plates 47 connected to the first and second side walls 31, 32 just as shown for the rollers 43 in the illustration of the loader magazine in FIGS. 3 and 4. Power means 44' are also provided for driving the rollers 45, 46 to continue movement of a workpiece in the feed direction A after initial engagement with the rollers 45, 46.

As shown in FIG. 9, the numerical control means (computer) 26 is operatively connected to the moveable components of the loader magazine 28, unloader magazine 28', and locator stops 13, 13'. The numerical control means 26 will first control the cylinder 41 to move the plunger 40 so that it pushes the top sheet in the stack in the loader mechanism 28 into operative engagement with the rollers 43. The motors 44 will then be operated to power the rollers 45, 46 so that the workpiece is moved onto the table 12 of the turret punch 10, the locator stops 13, 13'' having been controlled by operation of the cylinders 81, 83 so that they are remote from the clamps 14 but above the surface of the table to provide an edge guide and/or stop for the workpiece (in this regard it is noted that the drawings in FIG. 2 are not necessarily to scale). After the workpiece has been moved into engagement with the stop 13', the cylinders 83 are activated to move the workpiece toward the clamps 14, activating micro-switch 91 in such movement, which in turn effectuates movement of the members 90 of the clamping means 14 to tightly engage the workpiece. The motors 15, 16, 18, and 24 of the turret punch 10 are then operated by the computer 26 in a conventional manner to effect punching of the desired hole configurations in the workpiece W. Once punching is completed, the clamping means 14 are moved to a position facilitating unloading of the workpiece 14, the computer 26 controlls the clamping means 14 to release clamping, and the workpiece is ready to be moved off the table into the unloader magazine 28'. Movement off the table to the unloader magazine 28' may be accomplished by the next workpiece W being fed from the loader magazine initially pushing the workpiece on the table 12 until it goes into engagement with the roller mechanisms 43 of the unloader mechanism 28', at which point the motors 44 would be stopped and the motors 44' started by the computer control 26 to move the workpiece off of the table 12 before the next workpiece moved on; and/or the mechanism 94 may be operated to initially push the workpiece into engagement with the rollers 43 of the unloader magazine 28', after which the motors 44' would be actuated until the workpiece was in the receiving volume of the unloader magazine 28'.

The computer also controlls the power sources 60 of the magazines 28, 28' in the proper manner and sequence so that after the top workpiece is moved off of the stack in the loading magazine 28, the next workpiece in the stack will be moved upwardly into position to be acted upon by the plunger 40 and rollers 43. Similarly, once a workpiece is completely received by the unloader magazine 28', the motor 60 associated therewith will move the supports 24 downwardly so that the next workpiece may be moved by the rollers 43 onto the top of the stack.

Additionally, as shown in FIG. 9 the motors 53 and 68 may be controlled by the computer to automatically vary the volume of the magazines 28, 28' to receive sheets of different dimensions therein. The computer 26 also controlls the cylinders 81 to move the locator stops 13', 13" below the surface of the table 12 after they have preformed their locator and initial movement functions.

It will thus be seen that according to the present invention an assembly has been provided for use with a numerically controlled turret punch or the like that provides a simple and relatively inexpensive mechanism for automatic feeding and removal of workpieces from the punching station. While the invention has been herein shown and described in what is presently conceived to the most practical and preferred embodiment thereof, it will be apparent to those of ordinary skill in the art that many modifications may be made thereof within the scope of the invention. For instance, instead of utilizing the cylinders 83 for the locator stops 13', 13", the workpieces may be fed by the rollers 43 directly into operative association with the clamping means 14; and in such a case the actuator 92 for the micro-switch 91 may be reoriented to sense movement in this direction. All of the power sources, adjusting mechanisms, etc. disclosed may take different forms than those exactly illustrated, as long as they accomplish the desired results according to the invention. Thus, the invention is only to be limited to the scope of the following claims, which claims are to be broadly interpreted to encompass all equivalent structures and devices.

What is claimed is:

1. An assembly comprising a numerically controlled turret punch and an automatic workpiece feeding assembly therefor; said turret punch having workpiece clamping means, a punching station, means for moving said workpiece clamping means in each of two perpendicular horizontal directions with respect to said punching station, a table, and at least one locator stop associated with said table providing an original orientation for a workpiece to be brought into operative association with the clamping means;

said workpiece feeding assembly including a loader magazine located on one side of said table and having an adjustable volume for feeding a stack of workpieces to be fed to said turret punch; ejector means associated with said loader magazine for horizontally feeding workpieces one at a time in a feed direction from the loader magazine receiving volume to the turret punch; an unloader magazine, located on the opposite side of said table as said loader magazine, having an adjustable volume for receiving a stack of workpieces to be received from the turret punch; an automatic means for controlling said loader magazine and said unloader magazine to transfer each workpiece in a stack from said loader magazine to the turret punch, into said unloader magazine; further comprising power means associated with said at least one locator stop for moving said stop vertically between positions above and below said table, and for moving said stop horizontally toward and away from said clamping means so that a workpiece engaged thereby may be moved from a position horizontally spaced from said clamping means into operative association with said clamping means.

2. An assembly as recited in claim 1 further comprising sensing means mounted on said clamping means for sensing the movement of a workpiece into operative association therewith to activate said clamping means.

3. An assembly as recited in claim 1 wherein two locator stops are provided, with power means associated with each, the most remote of said locator stops from said loader magazine comprising two perpendicular abutment surfaces, and the closest of said locator stops from said loader magazine comprising one abutment surface generally parallel to the direction of feed of a workpiece from said magazine.

4. An assembly as recited in claim 1 wherein said automatic means for controlling said loader magazine and said unloader magazine to transfer each workpiece to a stack from said loader magazine to said turret punch and to said unloader magazine comprises numerical control means for activating said ejector means to move the top workpiece in the stack in said loader magazine into operative association with said turret punch; then activating said locator stop to move the workpiece engaged thereby horizontally into operative association with said clamping means; then activating said locator stop to move it vertically out of interfering relationship with the workpiece on the table; then activating said means for moving said workpiece clamping means and said punching station to operate on said workpiece to produce a finished workpiece of given construction; activating the means for moving said workpiece clamping means to move the workpiece to a predetermined ejection position after punching thereof; activating the clamping means to release clamping of the punched workpiece; activating said unloader magazine so that the stack of workpieces therein is moved downwardly to lower the top workpiece in the stack a desired amount so that the stack can receive the workpiece from the table thereon; and activating means, including means associated with said unloader magazine, for moving a workpiece from the table onto the stack in the unloader magazine; activating said locator stop so that it protrudes from the plane of the table for engagement of the next workpiece from the loader magazine; and activating said loader magazine so that the next workpiece in the stack is moved into position to be acted upon by said ejector means.

5. An assembly including a numerically controlled turret punch and an automatic workpiece feeding assembly; said numerically controlled turret punch having workpiece clamping means, a punching station, means for moving said workpiece clamping means in each of two perpendicular horizontal directions with respect to said punching station, a table, means for moving a workpiece on said table into operative association with said clamping means, and sensing means mounted on said clamping means for sensing the movement of a workpiece into operative association therewith to activate said clamping means; and said automatic workpiece feeding assembly comprising a loader magazine, located on one side of said table, having an adjustable volume for receiving a stack of workpieces to be fed to said turret punch; ejector means associated with said loader magazine for horizontally feeding workpieces one at a time in a feed direction from the loader magazine receiving volume to said turret punch to be moved into operative association with said clamping means; an unloader magazine, located on the opposite side of said table as said loader magazine, having an adjustable volume for receiving a stack of workpieces to be received from said turret punch after release by said clamping means; and automatic means for controlling said loader magazine and said unloader magazine to transfer each workpiece in a stack from said loader magazine to said turret punch and to said unloader magazine.

6. An assembly as recited in claim 5 wherein the adjustable volume for receiving a stack of workpieces for each of said loader magazine and said unloader magazine comprises first and second side walls disposed generally parallel to the direction of feed workpieces from or into said magazine, means for automatically adjusting the horizontal spacing between said first and second side walls, workpiece support members assiciated with each of said side walls, means for automatically vertically moving said workpiece support members with respect to said side walls, a third side wall member disposed generally perpendicularly to the direction of feed of workpieces from or into said magazine, and means for automatically horizontally moving said third side wall member in and opposite to the direction of feed.

7. An assembly as recited in claim 6 wherein said ejector means associated with said loader magazine comprise a moveable ejector plunger for engaging the top workpiece in a stack in said loader magazine, and means for operatively mounting said ejector plunger on said third side wall.

8. An assembly as recited in claim 7 wherein said ejector means further comprise two pairs of rollers operatively mounted to said first and second side walls at portions thereof remote from said third side wall for engagement with a workpiece moved by said moveable plunger in the feed direction, into operative association with said rollers, and power means for driving said rollers to continue feeding of a workpiece in said feed direction.

9. An assembly as recited in claim 6 wherein said means for automatically moving said third side wall member, and means for automatically adjusting the spacing of said first and second side walls, each comprise a rotatable screw, a travelling nut, and means for rotating said screw so that said travelling nut transforms rotation of said screw into linear movement of said walls with respect to each other.

10. An assembly as recited in claim 6 wherein said means for automatically vertically moving said workpiece support members comprise a ram operatively associated with each workpiece support member.

11. An assembly as recited in claim 6 wherein said unloader magazine further comprises two pairs of rollers operatively mounted to said first and second side walls at portions thereof remote from said third side wall for engagement of a workpiece being moved from a turret punch into the direction of feed thereinto, and power means for driving said rollers to continue movement of a workpiece in said feed direction after initial engagement with said rollers.

12. An assembly as recited in claim 6 wherein said unloader magazine further comprises means for engaging a workpiece from a turret punch and powering the workpiece into operative relationship with the stack of workpieces in the unloader volume for receiving workpieces.

13. An assembly as recited in claim 12 wherein said automatic means for controlling said loader magazine and said unloader magazine to transfer each workpiece in a stack from said loader magazine, to a turret punch or the like, and to said unloader magazine comprises numerical control means for activating said ejector means to move the top workpiece in the stack in said loader magazine into operative association with a turret punch or the like, and then activating said means for vertically moving said workpiece support members of said loader magazine to position the next workpiece in the stack into position to be acted upon by said ejector means, and activating said unloader magazine workpiece support members to lower the top workpiece in the stack to receive another workpiece thereon from a turret punch or the like; and activating the workpiece engaging means associated with the unloader magazine for moving a workpiece from a turret punch or the like onto the stack in the unloader magazine.

14. An assembly as recited in claim 13 wherein said numerical control means further comprises means for controlling the automatic adjustment of the horizontal spacing between the first and second side walls, and the means for automatically horizontally moving the third side wall member, so that the horizontal dimensions of the workpiece receiving volumes defined by said unloader and loader magazines are coincident, and are proper for the receipt of the particular workpieces to be acted upon.

15. An assembly as recited in claim 5 wherein said ejector means associated with said loader magazine comprise a moveable ejector plunger mounted on the loader magazine at a point rearmost with respect to the direction of feed, and roller means mounted on the loader magazine at points frontmost with respect to the direction of feed.

16. An assembly as recited in claim 5 wherein said unloader magazine further comprises means for engaging a workpiece from a turret punch and powering the workpiece into operative relationship with the stack of workpieces in the unloader volume for receiving workpieces.

* * * * *